United States Patent [19]

Williamson et al.

[11] Patent Number: 5,069,374

[45] Date of Patent: Dec. 3, 1991

[54] ELASTICIZED STOCKING REMOVAL SYSTEM

[76] Inventors: Nina J. Williamson, 218 Shifting Log Dr., Hampton, Va. 23669; Dawn L. Bingham, 580 11th Ave., Cir. NW., Hickory, N.C. 28601; Mary B. Bauman, 6 Walnut, N. Kingstown, R.I. 02852

[21] Appl. No.: 580,646

[22] Filed: Sep. 11, 1990

[51] Int. Cl.[5] ..... A47G 25/90; A47G 25/80

[52] U.S. Cl. ..... 223/111; 223/112

[58] Field of Search ..... 223/111, 112, 113, 114, 223/115, 116, 117, 118, 119, 60, 75, 77

[56] References Cited

U.S. PATENT DOCUMENTS

| | | | |
|---|---|---|---|
| 129,175 | 7/1872 | Russell | 223/113 |
| 2,796,207 | 6/1957 | Young | 223/111 |
| 2,828,057 | 3/1958 | MacLaughlan | 223/111 |
| 3,070,271 | 12/1962 | Kennedy, Sr. | 223/111 |
| 3,401,856 | 9/1968 | Berlin | 223/111 |
| 3,452,907 | 7/1969 | MacLaughlan | 223/111 |
| 4,072,255 | 2/1978 | Bogorad | 223/111 |
| 4,130,226 | 12/1978 | Farrell | 223/111 |
| 4,638,932 | 1/1987 | Keller | 223/113 |
| 4,756,453 | 7/1988 | Pettit et al. | 223/111 |

*Primary Examiner*—Werner H. Schroeder
*Assistant Examiner*—Bibhu Mohanty
*Attorney, Agent, or Firm*—Larson & Taylor

[57] ABSTRACT

A device as provided to assist a person with removing an elasticized stocking. A cord has a plurality of filaments at one end thereof which are attached by clips around the upper end of the stocking. The cord extends around a pulley disposed beneath the foot portion of the stocking and the other end of the cord may be grasped by the wearer and by pulling the cord the stocking may be removed. Mechanical or motorized winding mechanism may be used to remove the stocking in place of manually pulling the cord. In another embodiment the pulley may be replaced by a rotatable power driven shaft disposed beneath the foot portion of the stocking so that the cord may be wound around the shaft to remove the stocking.

7 Claims, 2 Drawing Sheets

ELASTICIZED STOCKING REMOVAL SYSTEM

FIELD OF THE INVENTION

This invention relates generally to an apparel apparatus and more specifically, to a system enabling a wearer of elasticized stockings to remove the stockings independently.

BACKGROUND OF THE INVENTION

An elasticized stocking of any standard construction tightly envelops the leg of a wearer. As is well known, the force with which an elasticized stocking engages the leg may render it quite difficult, if not impossible, for the wearer to remove. Wearers of such stockings are usually infirm or advanced in years and often do not possess the physical strength to remove the stockings without the aid of another person.

With the time availability of hospital staff at a premium, there is a need for a device that will reduce or eliminate the need for hospital staff utilization for the removal of elasticized stockings. Prior art devices of this kind include U.S. Pat. No. 4,756,453 (Pettit et al.) and U.S. Pat. No. 4,638,932 (Keller).

The Pettit et al. patent discloses a device utilizing a pair of posts connected by a hinge. Each post is fitted with a hosiery inversion arm. A user places a sock or other hosiery over both arms, the top inverted and the sock toe extending downward between the arms. The user then spreads the posts apart to stretch the sock open and pushes a foot into the open sock, the sock unfolding as it is mounted on the foot.

The Keller patent discloses a combination tool to pull up socks, shorts, and trousers, comprising a tong-like member having a pair of elongated arms extending from a handle and to a gripping end. The arms are integrally joined at the handle end in a "U" bend and extend in close side-by-side relationship to the gripping end. Resilient protective pads are provided at the gripping end of each arm to hold a sock or other item of clothing.

The above mentioned devices provide a mechanical extension of one's hand to grip and pull on socks and other items of clothing. Connecting the clamps and fastening devices of such prior art devices to sides of a sock or stocking opening can be time consuming and an awkward task, particularly for the infirmed. The same is true for devices which require spreading the sock apart under enough tension that the sock will stay on the frame while being pulled on. It requires some force to spread a frame member apart sufficiently to stretch the sock or stocking to the point where it will not pull away from the frame as the sock is pulled on the user's foot. It also requires some dexterity to manipulate the complicated assembly of spreading devices disclosed in the prior art devices. The level of dexterity required to use the above mentioned devices may not be available to a handicapped or infirm person.

Although all of the above-discussed devices relate to apparatus to aid in dressing or removing socks and stocking they have the various disadvantages mentioned above.

SUMMARY OF THE INVENTION

The elasticized stocking removal system according to the present invention provides an independent means of removing elasticized stockings or other hosiery in either a hospital or residential setting. This invention provides both a manual and automatic stocking removal system comprising stocking attaching means, a cord attached at one end to the attaching means, and means at the other end of the cord for generating tension in the cord. The means for generating tension will vary depending on whether or not the device is configured for manual or automatic operation. The major advantage of this system is that the system not only provides independent stocking removal when assistance is not available but also provides effective time-saving stocking removal in hospital or residential settings where health care hours are at a premium.

Other features and advantages of the invention will be set forth in, or apparent from, the following detailed description of the preferred embodiment of the invention.

DESCRIPTION OF THE PREFERRED EMBODIMENTS

Figure 1:
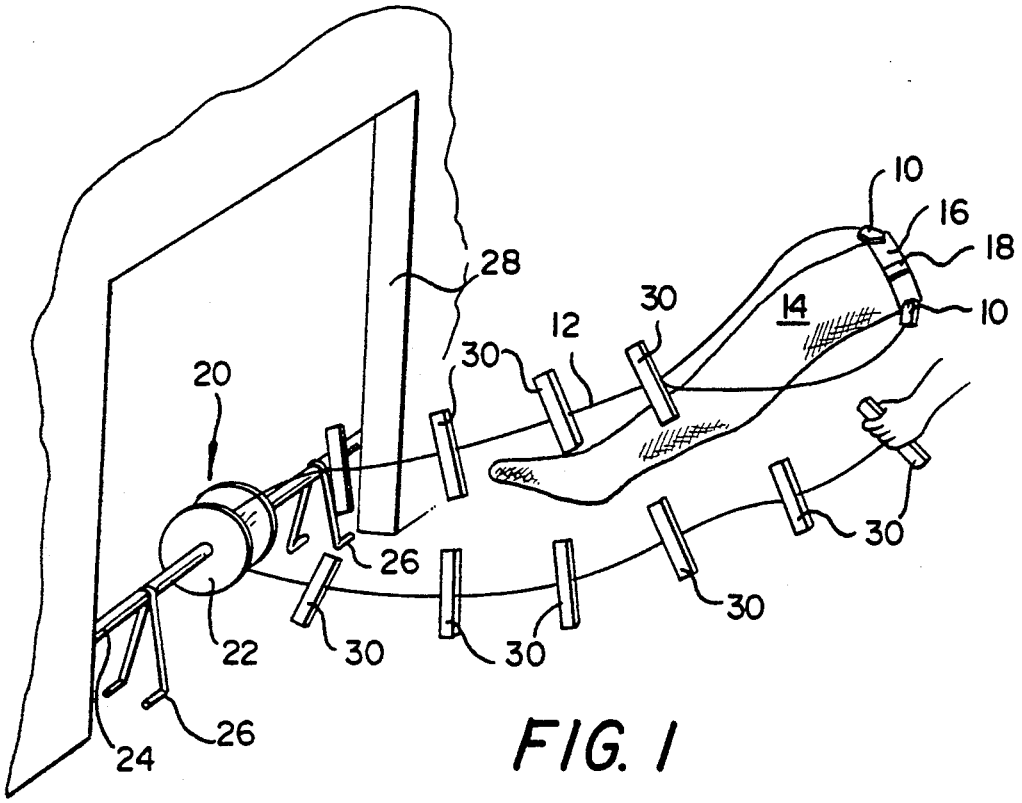
FIG. 1 is a perspective view of an elastic stocking removal system constructed in accordance with a preferred embodiment of the invention.
Figure 2:
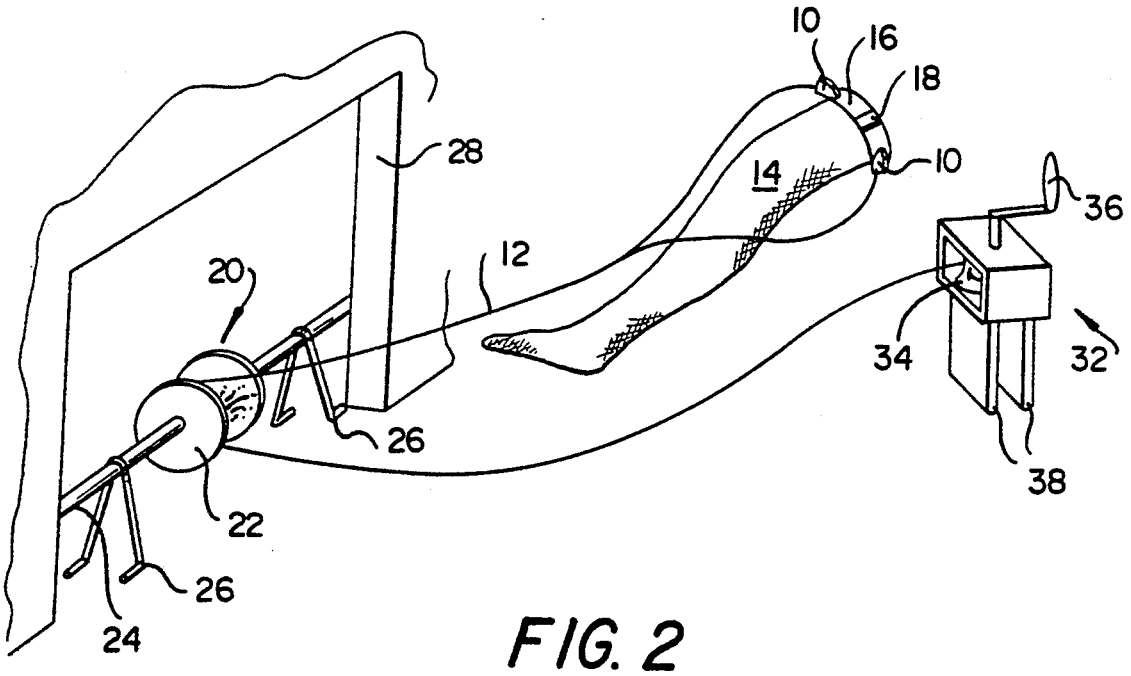
FIG. 2 is a perspective view of an alternate embodiment of the elastic stocking removal system illustrated in FIG. 1.
Figure 5:
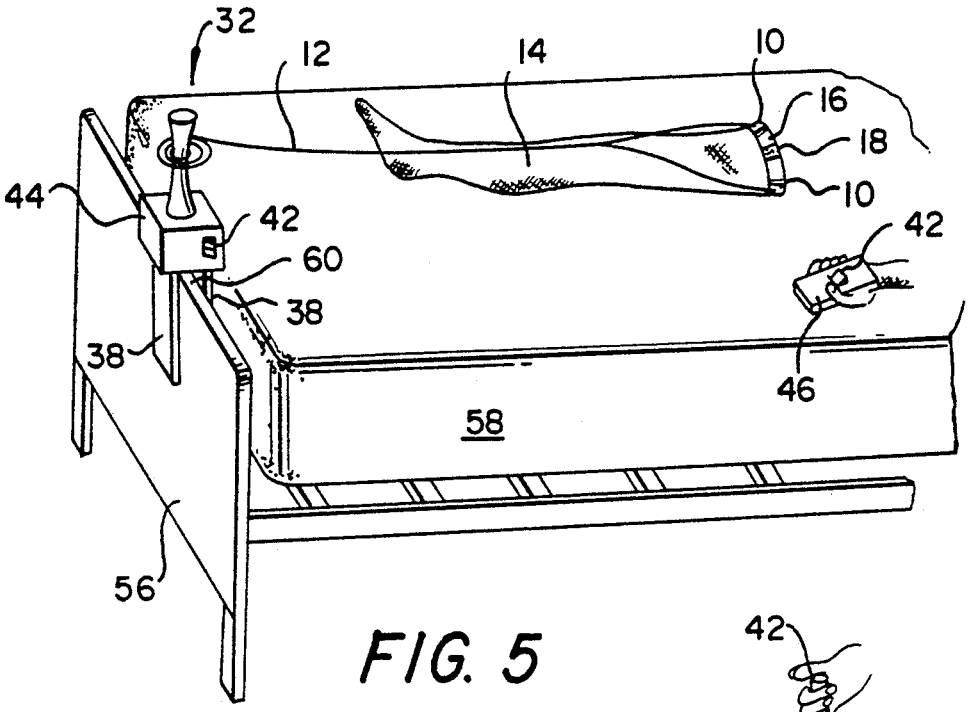
FIG. 5 is a perspective view of yet another alternate embodiment of an elastic stocking removal system.

Referring to FIGS. 1, 2, and 5, an elastic stocking removal system constructed in accordance with a preferred embodiment of the invention is shown. The device comprises a plurality of attaching clips 10 for attaching a line or cord 12 to either typical garter snaps (not shown) or hook and loop type fastener such as "Velcro" (not shown) or to a ring or band 16 on a stocking 14 mouth. The cord 12 is constructed so as to have one end formed with a plurality of separate filaments which connect to attaching clips 10 and the other end, which is a single filament, attached to a winding assembly described below. Band 16 is constructed of a rigid or semi-rigid material such as metal, plastic, rubber, elastic, or the like. The band 16 is attached or mounted at or near the stocking 14 mouth and provides a rigid or semi-rigid region over which the stocking mouth could be rolled. Located on the surface of band 16 is a closure region 18 which may be hook and loop type fastener such as "Velcro" or other fastener known in the art. This closure region permits the circumference of band 16 to be adjusted to accommodate different size legs. Line 12 is of a length long enough to allow it to extend to and back from a pulley mechanism 20. In a preferred embodiment pulley mechanism 20 comprises a pulley 22 which is rotatably mounted on a support bar 24. Support bar 24 is held off of the floor by a pair of legs 26 that are attached to support bar 24 at an equal distance from either side of pulley 22. Pulley mechanism 20 is placed against the side of a door jam 28 opposed to the location of the user so as to prevent movement of the pulley mechanism in the direction of the user. Cord 12 has handle sections 30 spaced approximately at one foot intervals along the entire length of the single filament of the cord 12.

The device functions by a person hooking the attaching clips of cord 12 to either a pair of garter snaps or hook and loop type fastener such as Velcro or to band 16. The cord 12 is then threaded around pulley mechanism 20. In a preferred embodiment, this is accomplished by threading cord 12 around pulley 22 and then placing pulley structure 20 behind door jam 28. The device may be actuated by providing tension on cord 12. This may be accomplished by grabbing the last handle section 30 with the user's hand and pulling handles, hand over hand, towards the user or by actuating a motor (not shown) to provide tension in the line.

Figure 3:
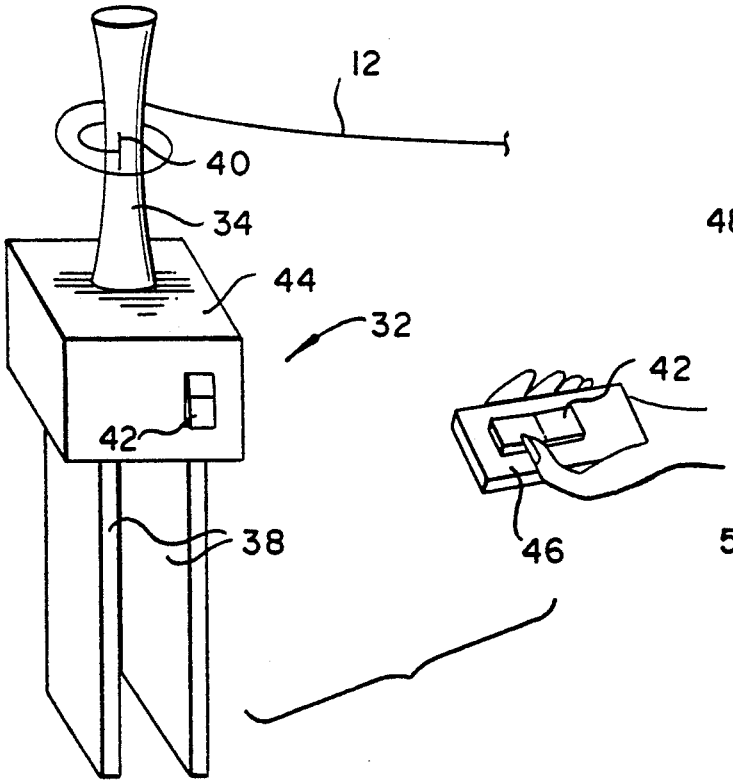
FIG. 3 is a perspective view of a motor for operating the elastic stocking removal system illustrated in FIG. 2.

FIGS. 2 and 3 illustrate an alternate embodiment of an elastic stocking removal system in which cord 12 does not have any handle sections 30. This embodiment has a winding assembly 32 which comprises a spool 34 which is used to wind cord 12. This winding may be accomplished either manually by turning a handle 36 or automatically by actuating a motor (not shown) to turn spool 34 so as to wind cord 12. Winding assembly 32 is secured in a location convenient to stocking wearer such as a side bed-rail. For automatic operation as illustrated in FIG. 3, spool 34 has an eyelet 40 in which cord 12 is fed. The motor is either actuated by depressing an on/off switch 42 located on the winding assembly housing 44 or by depressing an on/off switch 42 on a remote control unit 46.

Figure 4:
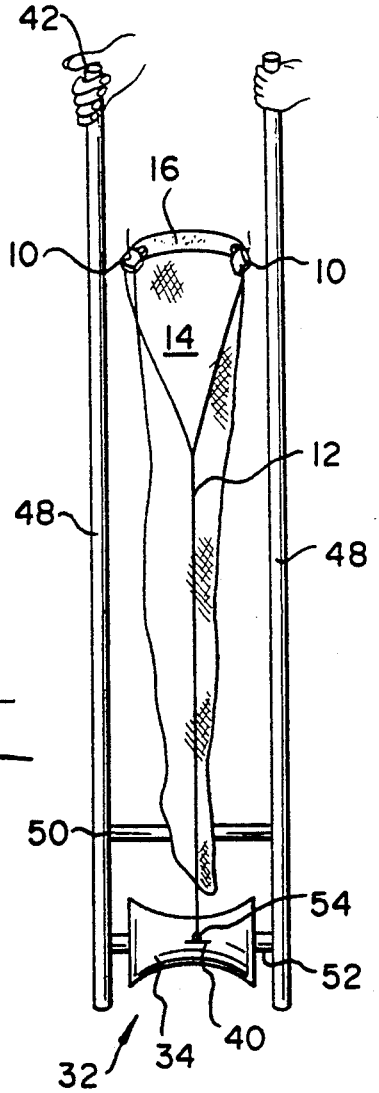
FIG. 4 is a front elevational view of another alternate embodiment of an elastic stocking removal system.

FIG. 4 illustrates another alternate embodiment of an elastic stocking removal system. This embodiment comprises a set of rails, 48 that are spaced apart by a foot support 50 located close to the bottom of the rails 48. Winding assembly 32' is placed below foot support 50 and comprises a spool 34' which has an eyelet 40. The winding assembly 32' is secured to the set of rails 48 by a support bar 52. The device functions by a person connecting attaching clips 10 to garter snaps or hook and loop type fastener such as "Velcro" or band 16' and then placing a hook 54 that is attached to the other end of cord 12 into eyelet 40. Then the device is actuated by pressing on/off switch 42, located at the upper/near end of rails 48. The pressing of on/off switch 42 actuates a motor (not shown) which in turn winds cord 12 around spool 34.

FIG. 5 illustrates an alternate embodiment of FIG. 2 where the winding assembly 32 may be mounted securely on a foot board 56 of a bed 58. This is accomplished by adjusting a gap 60 between legs 38 so that the foot board 56 may slide between the legs 38.

Although the present invention has been described to specific exemplary embodiments thereof, it will be understood by those skilled in the art that variations and modifications can be effected in these exemplary embodiments without departing from the scope and spirit of the invention.

We claim:

1. A stocking removal system for removing an elasticized stocking from the leg, the stocking having a foot portion and open upper end, the stocking removal system comprising in combination, cord means, attachment means for securing one end of said cord means at the open upper end of the stocking, cord engaging means disposed adjacent the foot portion of the stocking for receiving said cord means so that when the cord means is tensioned around said cord engaging means the upper end of the stocking is drawn downwardly towards the foot portion of the stocking to remove the stocking.

2. A stocking removal system according to claim 1 wherein said attachment means comprises clips.

3. A stocking removal system according to claim 1 wherein said cord means is provided with a plurality of filaments at said one end thereof for attachment at a plurality of points at the open upper end of the stocking.

4. A stocking removal system according to claim 1 and further including a plurality of handles disposed in spaced relation along the length of said cord means.

5. A stocking removal system according to claim 1 wherein said cord engaging means comprises a motor driven rotatable shaft with the other end of said cord means secured to the rotatable shaft.

6. A stocking removal system according to claim 1 wherein said cord engaging means comprises a pulley.

7. A stocking removal system according to claim 6 and further including means engaging the other end of said cord means to tension the cord and to draw the open upper end of the stocking towards the foot portion of the stocking as the cord means is taken up by a winding means.

* * * * *